US007798472B2

(12) United States Patent
Vankeuren, II et al.

(10) Patent No.: US 7,798,472 B2
(45) Date of Patent: Sep. 21, 2010

(54) LOAD BALANCING HOIST

(75) Inventors: Oliver W. Vankeuren, II, Palm Harbour, FL (US); William Pinciaro, Tampa, FL (US)

(73) Assignee: Tri-Motion Industries, Inc., Tampa, FL (US)

( * ) Notice: Subject to any disclaimer, the term of this patent is extended or adjusted under 35 U.S.C. 154(b) by 122 days.

(21) Appl. No.: 12/020,893

(22) Filed: Jan. 28, 2008

(65) Prior Publication Data

US 2009/0188883 A1 Jul. 30, 2009

(51) Int. Cl.
*B66D 1/26* (2006.01)

(52) U.S. Cl. ..... 254/278; 254/288; 254/394; 254/396; 254/398

(58) Field of Classification Search ..... 254/278, 254/284, 288, 331, 393, 394, 396, 398
See application file for complete search history.

(56) References Cited

U.S. PATENT DOCUMENTS 2,176,979 A 10/1939 Platz
2,500,879 A 3/1950 Smallpeice
2,613,903 A 10/1952 Platz
3,669,411 A 6/1972 McKendrick
3,675,899 A 7/1972 McKendrick
3,773,296 A 11/1973 McKendrick
5,522,581 A 6/1996 Kulhavy
5,553,832 A 9/1996 Zaguroli, Jr.
5,984,276 A * 11/1999 Green ..... 254/360
7,134,644 B2 11/2006 Wallner et al.

FOREIGN PATENT DOCUMENTS

DE 8124068 3/1982
DE 3133422 A1 3/1983
GB 1563976 A 4/1980
GB 1567271 A 5/1980

* cited by examiner

*Primary Examiner*—Emmanuel M Marcelo
(74) *Attorney, Agent, or Firm*—Gifford, Krass, Sprinkle, Anderson & Citkowski, P.C.

(57) ABSTRACT

A load balancing hoist constructed to combine the power module and the travel module of the hoist into a single unit to substantially reduce the cost and the length of the hoist without effecting its operation and application.

3 Claims, 2 Drawing Sheets

LOAD BALANCING HOIST

FIELD OF THE INVENTION

The present invention relates to a load balancer and more particularly to a pneumatically operated load balancing hoist.

DESCRIPTION OF THE PRIOR ART

Fluid operated hoists which include means for balancing the load while the load is being raised, lowered, or moved from one position to another have been in use for a number of years. Such hoists are in common use for supporting loads such as workpieces or tools that have to be positioned relative to a work operation where the loads are too heavy to be conveniently manipulated by hand at all or for any extended period of time.

An early example of such a load balancing hoist can be found in U.S. Pat. No. 2,500,879 to C. D. P. Smallpiece. That patent illustrates a pneumatically operated hoist in which balancing is achieved by moving a piston within a housing to move a pulley through a piston rod to raise and lower a hoisting cable. A manually operated control valve regulates the pressure applied to the piston to achieve the balancing effect for the hoist as the workload is manipulated.

U.S. Pat. Nos. 3,669,411 and 3,675,899 both issued to McKendrick disclose balancers similar in construction to the Smallpiece patent. These patents are directed to the control circuit for controlling operation of the balancer.

SUMMARY OF THE INVENTION

The present invention provides a load balancing hoist that is substantially less costly to produce than load balancing hoist of the prior art. Such prior art hoists are commonly constructed as shown in FIG. 1 accompanying this description and include a power module having as a part thereof a pneumatically actuated piston and piston rod assembly which moves a moveable pulley in a travel module toward and away from a fixed pulley to raise and lower the cable carrying a load. The distance the travel module is permitted to move determines the length that the cable can be extended from the hoist.

As will be apparent as the description of the balancing hoist of the present invention proceeds the power module and the travel module of prior art devices has been combined into a single unit. The piston rod of the prior art construction has been eliminated and the result is a compact load balancing hoist that is less costly to produce than those of the prior art without sacrifice to its operation or application.

BRIEF DESCRIPTION OF THE DRAWINGS

A preferred embodiment of the improved load balancing hoist of the present invention is illustrated in the following drawings in which.

DETAILED DESCRIPTION OF THE PREFERRED EMBODIMENTS

Figure 1:
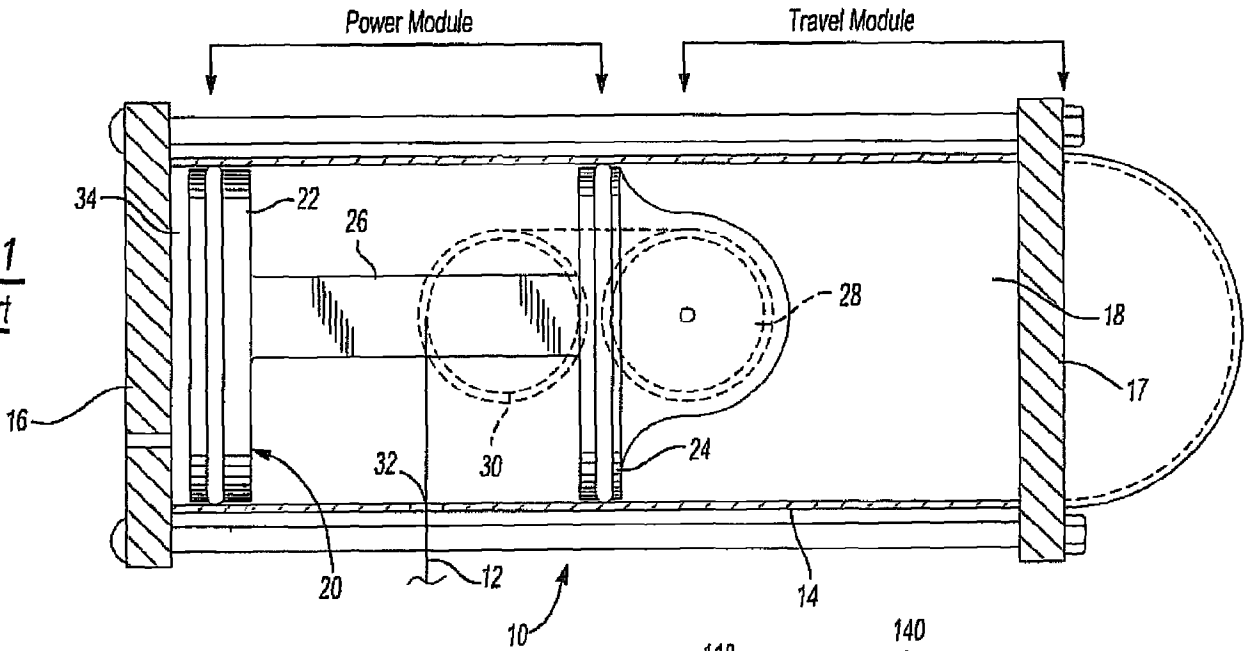
Fig-1 Prior Art
FIG. 1 is a longitudinal cross sectional view illustrating a load balancing hoist constructed in the manner shown in the prior art.

FIG. 1 illustrates a load balancing hoist constructed in accordance with the prior art. The hoist 10 shown in FIG. 1 is constructed substantially like the hoist shown in U.S. Pat. No. 3,669,411. A cable 12 extends from the hoist 10 to support a load (not shown) at the end of the cable 12.

The hoist 10 includes a housing 14 having one end closed by a front end cap 16 and the other end closed by a rear cap 17 to define a cylindrical chamber 18. A dual piston assembly 20 is supported for movement axially within the chamber 18 and is comprised of a pressure piston 22 and a support piston 24 axially spaced and connected to each other by a tie rod 26 so as to be movable in the chamber 18 as a unit. A pulley 28 is rotatably mounted to the support piston 24 and a pulley 30 is rotatably fixed to the housing 14 within the chamber 18 such that movement of the piston assembly 20 causes the pulley 28 to move toward and away from the pulley 30.

One end of the cable 12 is anchored to the housing 14 within the chamber 18 and extends over the pulleys 28 and 30 and from the housing 18 through an opening 32 so that movement of the pulley 28 toward and away from the pulley 30 within the chamber 18 causes the cable 12 to extend from and to retract into the housing 14 through the opening 32.

A fluid pressure chamber 34 is formed in one end of the chamber 18 and fluid under pressure is directed into and exhausted from the pressure chamber 34 to cause the pressure piston 22 to move in the chamber 18 causing the pulley 28 to move toward and away from the pulley 30 to extend, retract, and balance the load carried by the cable 12.

The piston assembly 20 and the portion of the chamber 18 utilized by the piston assembly 20 as the hoist 10 is being used is considered to be the "power module" of the hoist 10 while the pulley 28 and the portion of the chamber 18 occupied by the pulley 28 as it is moving through the chamber 18 is considered to be the "travel module" of the hoist.

What has been described to now is conventional in the prior art and forms no part of the present invention. A hoist will now be described which is a considerable improvement over the prior art. The hoist of the present invention, which will become much more apparent as the description proceeds, combines the power module and the travel module into a single unit thus resulting in a less costly hoist requiring less chamber length to achieve the same length of travel for the cable than in prior art devices and requiring less parts and being much simpler in construction and less costly to produce than prior art hoists.

Figure 3:
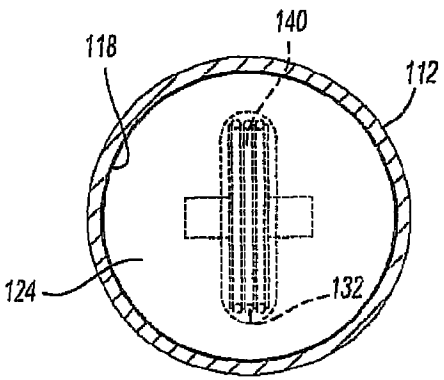
FIG. 3 is a transverse cross sectional view of the hoist shown in FIG. 2 taken substantially at line 3-3 of FIG. 2.
Figure 4:
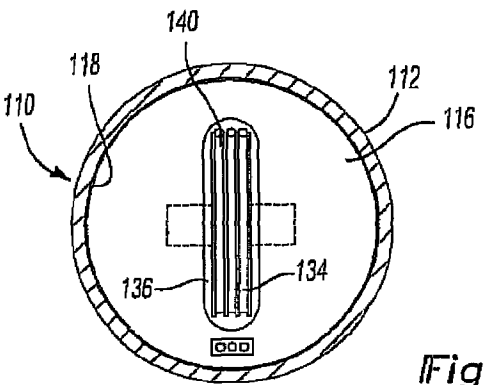
FIG. 4 is a transverse cross sectional view similar to FIG. 3 but taken substantially along line 4-4 of FIG. 2.
Figure 2:
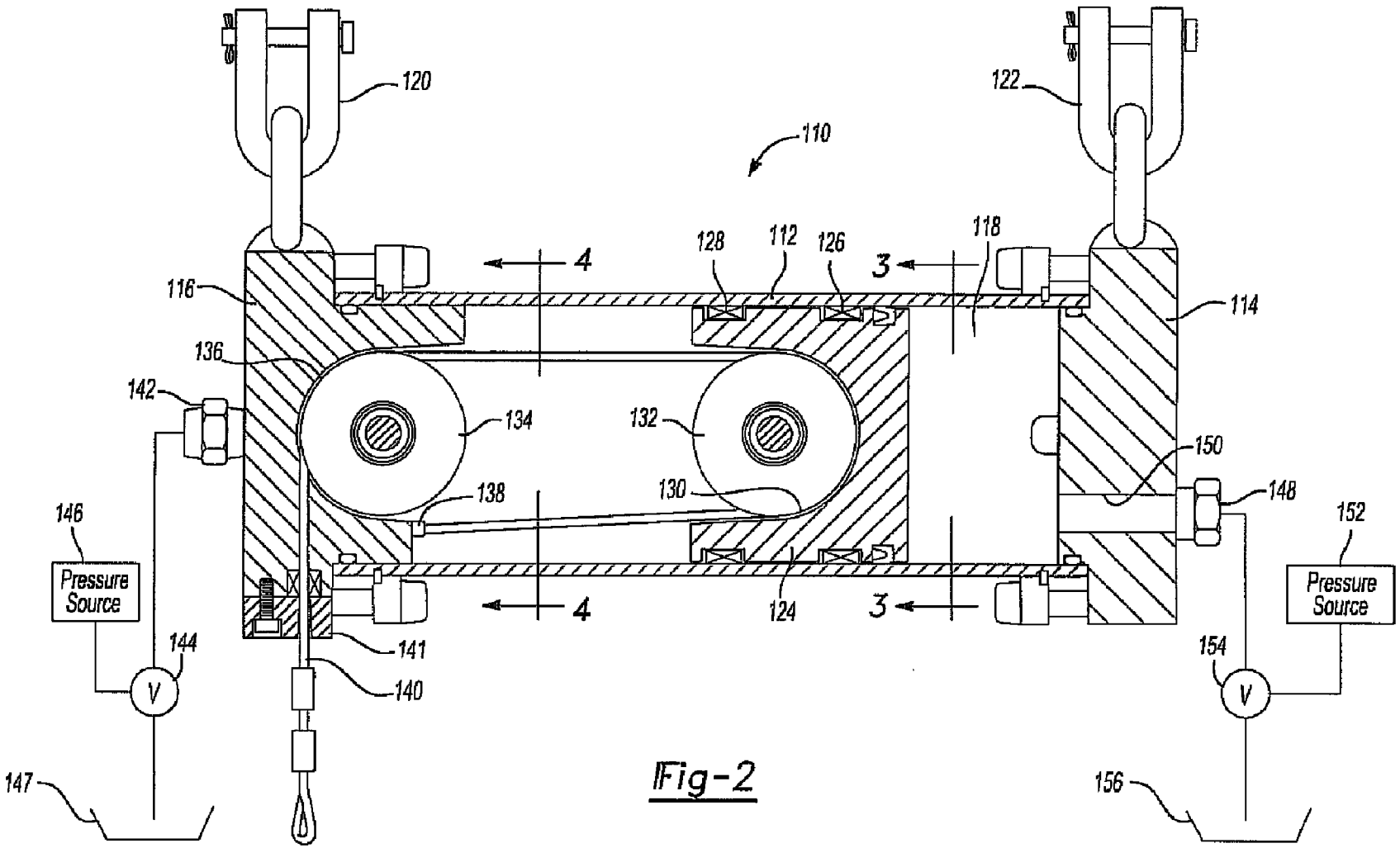
FIG. 2 is a longitudinal cross sectional view of a load balancing hoist of the present invention.

As can best be seen in FIGS. 2-4 the hoist 110 of the present invention includes a substantially cylindrical housing 112 closed at each end by end caps 114 and 116 to from a substantially cylindrical chamber 118. The caps 114 and 116 are provided with chain link connectors 120 and 122 respectively which are adapted to be mounted to a rail or the like (not shown) to support the hoist 110 in the workplace.

A piston 124 is axially slidably mounted within the chamber 118 and is provided with spaced seal rings 126 and 128 to seal the chamber from fluid communication across the piston 124. The piston 124 is provided with removed portion 130 on the side of the piston 124 facing the end cap 116 and a pulley 132 is rotatably mounted within the portion 130 of the piston 124 so that the piston 124 and the pulley 132 travel together in the chamber 118.

A second pulley 134 is mounted in a removed portion 136 of the end cap 116 to be fixed to the end cap 116 but to rotate about an axis parallel to and substantially aligned with the axis of rotation of the pulley 132. One end 138 of a cable 140 is anchored to the end cap 116 within the housing 112. The cable 140 extends over the pulleys 132 and 136 and exteriorly of the hoist 110 through the end cap 116. A seal 141 is provided in the end cap 116 to prevent a pressure leak where the cable 140 extends though the end cap 116.

As the piston 124 moves axially in the chamber 118 toward and away from the pulley 134 the cable 140 is extended and retracted from the housing 112. As can best be seen in FIGS. 3 and 4 the pulleys 132 and 134 are constructed to permit several turns of the cable 140 to be carried by the pulleys 132 and 134 and the length of cable which can be extended from the hoist is determined by the number of turns of the cable 140 provided by the pulleys 132, 134.

The end cap 116 is provided with a connector 142 that provides communication (not shown) through the end cap 116 to the chamber 118 between the piston 124 and the end cap 116. The connector 142 is connected to a source 144 of fluid pressure, preferably pneumatic pressure, though a valve 146. The valve 146 is constructed to selectively provide pressure from the source 144 or to exhaust as shown at 147.

The end cap 114 is provided with a connector 148 that provides communication through a passage 150 in the end cap 114 to the chamber 118 between the piston 124 and the end cap 114. The connector 148 is connected to a source 152 of fluid pressure, preferably pneumatic pressure, though a valve 154. The valve 154 is constructed to selectively provide pressure from the source 152 or to exhaust as shown at 156.

It should be apparent that selectively operating the valves 146 and 154 the piston 124 can be moved axially within the chamber 118 to extend and retract the cable 140 and to maintain the load (not shown) on the end of the cable 140 in the desired position. Regulating the pressure against each side of the piston 124 can act to balance the load so that even a heavy load can be moved by hand with minimum effort.

Also it should be apparent that other controls than those illustrated can be utilized to achieve the desired manipulation of the load in the load balancing hoist of the present invention. The controls are not a part of the present invention. Although pneumatic pressure has been disclosed as the force used to move and to balance the piston 124, other forms of fluid pressure such as hydraulic pressure could be used as well.

The construction of the present invention provides a load balancing hoist that has combined the power module and the travel module found in prior art constructions into a single unit. This is accomplished by mounting one of the pulleys that carries the cable to a position within the end cap and the other pulley within and to the piston. This substantially reduces the necessary length of the hoist and substantially reduces the cost of manufacturing a hoist of this type by reducing the number of necessary parts.

It should also be apparent that although a preferred embodiment of the load balancing hoist of the present invention has been disclosed changes and modifications can be mad to the disclosed embodiment without departing from the spirit of the invention or the scope of the appended claims.

We claim:

1. A pressurized fluid operated load balancer hoist for supporting and moving a load, said hoist comprising;

a) a housing defining an interior chamber and having first cap closing off one open end of the housing and a second cap closing off an opposite open end of the housing, the first cap having a removed portion opening toward the chamber;

b) a piston moveable within the chamber of said housing and having a removed portion opening toward the first cap, the piston being operable to contact the first cap during operation of the hoist;

c) a first pulley rotatably mounted in the removed portion of the first cap;

d) a second pulley rotatably mounted in the removed portion of the piston and moveable therewith toward and away from said first pulley, each of the first and second pulleys being recessed within their respective removed portions so as to not contact each other when the piston contacts the end cap;

e) a cable wound around and extending between said pulleys and having one end anchored within said chamber to the first cap;

f) the other end of said cable extending from said housing for attachment to and supporting the load thereon whereby movement of said piston toward said first pulley causes said cable to be lowered from said housing to lower the load and movement of said piston away from said first pulley retracts said cable into said housing to raise the load; and g) fluid pressure chambers on each side of said piston and a control for introducing pressurized fluid to and exhausting fluid from each of said chambers to control movement of said piston and said cable.

2. The hoist as defined in claim 1 and which said cable extends through said first cap.

3. The hoist as defined in claim 2 and including a seal mounted within said first cap and said cable extending through said seal.

* * * * *